United States Patent [19]

Sarnes et al.

[11] 4,002,471

[45] Jan. 11, 1977

[54] METHOD OF MAKING A THROUGH-HARDENED SCALE-FREE FORGED POWDERED METAL ARTICLE WITHOUT HEAT TREATMENT AFTER FORGING

[75] Inventors: Myron C. Sarnes; Robert N. Haynie, both of Northville, Mich.

[73] Assignee: Federal-Mogul Corporation, Detroit, Mich.

[22] Filed: Sept. 24, 1973

[21] Appl. No.: 400,071

[52] U.S. Cl. ..... 75/200; 148/126

[51] Int. Cl.[2] ..... B22F 3/00

[58] Field of Search ..... 148/126; 75/200

[56] References Cited

UNITED STATES PATENTS

| | | | |
|---|---|---|---|
| 3,416,976 | 12/1968 | Brill-Edwards | 148/126 |
| 3,658,604 | 4/1972 | Hale | 148/126 |
| 3,810,756 | 5/1974 | Koehler | 148/126 |

FOREIGN PATENTS OR APPLICATIONS

| | | | |
|---|---|---|---|
| 794,289 | 9/1968 | Canada | 148/126 |

OTHER PUBLICATIONS

Call, *Powder Metallurgy*, 1970, vol. 13, No. 2b, pp. 156–164.

Brown et al, *Int. J. Pow. Met.*, vol. 6, No. 4, Oct. 1970, pp. 29–42.

Hirschhorn et al, *Metal Forming*, Nov. 1970, vol. 37, No. 1, pp. 320–327.

Mott, *Precision Metal Molding*, Oct. 1952, vol. 10, No. 10, pp. 38–39, 89, 90–94.

*Primary Examiner*—Brooks H. Hunt

*Attorney, Agent, or Firm*—Robert F. Hess

[57] ABSTRACT

A method of making forged powdered iron base metal articles of high Rc hardness without need for further machining, surface treatment nor heat treatment after quenching comprising forming a pre-alloyed metal powder, compressing said powder into a briquette, sintering said briquette into a preform, heating said preform to a temperature above its austenizing temperature, forging said preform while above its austenizing temperature into a forged article, permitting the article to cool to approximately its austenizing temperature, and promptly quenching said forged article in a quenching batch.

6 Claims, 1 Drawing Figure

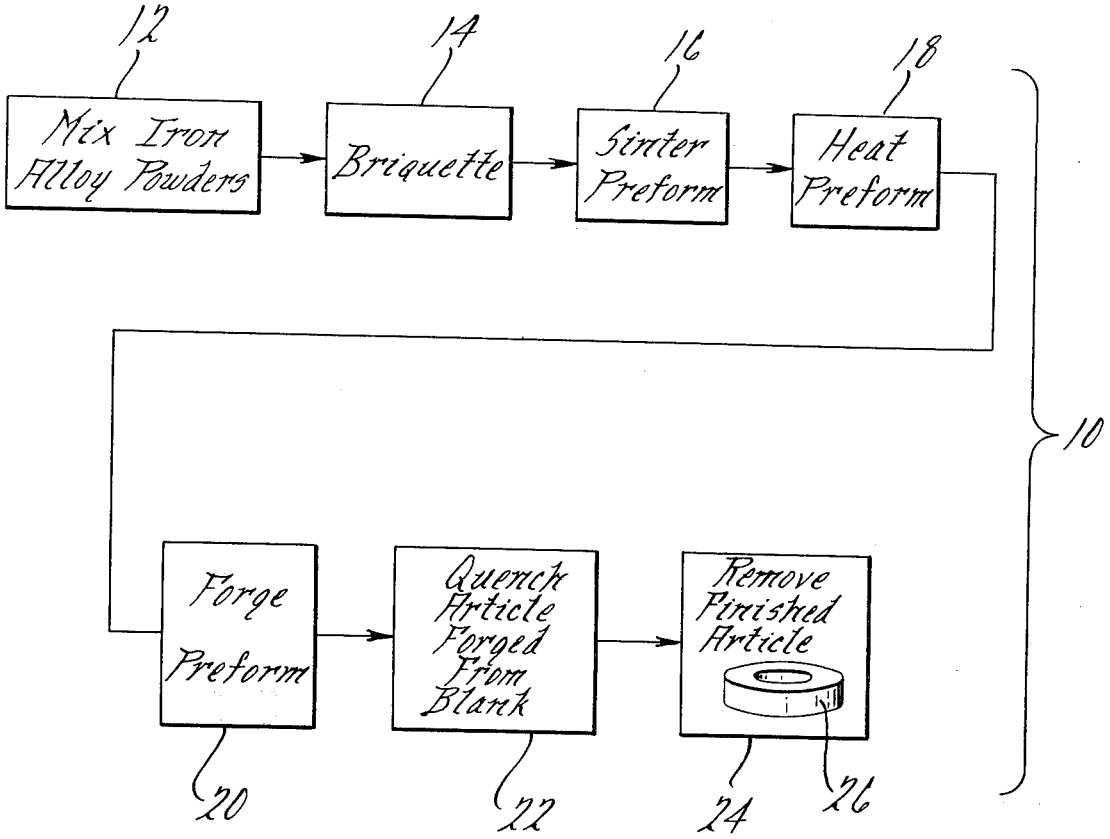
12
Mix Iron Alloy Powders
14
Briquette
16
Sinter Preform
18
Heat Preform
10
Forge Preform
20
Quench Article Forged From Blank
22
Remove Finished Article
24
26

METHOD OF MAKING A THROUGH-HARDENED SCALE-FREE FORGED POWDERED METAL ARTICLE WITHOUT HEAT TREATMENT AFTER FORGING

BACKGROUND OF THE INVENTION

Relatively small forged iron base metal articles can be produced from wrought stock or powdered metal, the latter being a relatively new technique of compacting metal powders.

To produce such an article of high Rc hardness, generally in the order of Rc 60, which means substantially high martensitic content, coupled with good surface finish and dimensional stability requires subjecting the wrought article after forging to at least the additional steps of cooling, machining, and rehardening. Each subsequent step is not only expensive but introduces different metal conditions which must be accounted for in the next following process step.

The forging of powdered metal preforms has consequently come into acceptance as a metal working process because of its chief advantage in eliminating the machining operations necessary with wrought material. In such process pre-alloyed metal powders are admixed with graphite, and lubricant compacted into briquettes, sintered, and forged. While desirable, the full benefits of this relatively new procedure have not been fully realized.

For example, in the manufacture of powdered iron base metal articles having hardness at the working surface of Rc 60 or thereabouts it has heretofore always been thought necessary to either (a) use a carbon content of 0.2–0.3 percent by weight and then carburize and subsequently harden the article, or b) use a carbon content of 0.5–0.7 percent and then austenize the article and quench it. While there are different specific ways to accomplish each processing method (a) and (b), these are well known in the art and it is sufficient for purposes of illustrating our invention to explain that while each achieves the surface hardness and surface finish desired, each such method causes undesired dimensional changes in the article itself due to the heat effect.

SUMMARY OF THE INVENTION

The present invention overcomes the above stated problems heretofore associated with powder metallurgy forging and permits the one-step forging of articles having the desired density, hardness, and closer dimensional tolerances, as well as articles which are free from surface and internal defects. In addition, our inventive process is capable of producing an article of substantially uniform high Rc hardness throughout, rather than mere surface hardness as obtained with carburizing.

Briefly stated, the present invention comprises a method of making a through-hardened, scale-free forged powdered metal article having a density of at least about 99.5% of theoretical density directly from forging and quenching comprising: compressing an iron alloy powder into briquette; sintering said briquette into a sintered preform; adjusting the temperature of said heated preform to its austenizing temperature; forging said heated preform while above said austenizing temperature into a forged article; cooling the forged article to about its austenizing temperature; immediately quenching said forged article in a quenching bath after said cooling; and removing said quenched forged article from the quenching bath in a continuous cycle.

DESCRIPTION OF THE DRAWINGS

The drawing shows a flow diagram illustrating the main procedural steps employed in carrying out the method of the present invention.

DETAILED DESCRIPTION

Referring to the drawing, there is shown a flow diagram of the method, generally designated 10, in which the initial step is preparation of the prealloyed metal powder 12. The formulation of the powder will vary widely dependent upon the characteristics desired in the final article. Iron, of course is the major constituent with varying amounts of such metals as manganese, molybdenum, and nickel being added. Carbon, in the form of graphite, is added prior to briquetting. In actual operation, it is preferred to first alloy the iron and other metals in the usual manner and to atomize the alloy to produce an iron alloy powder. The iron alloy powder is then admixed with the graphite and with a lubricant. Such lubricants are conventionally waxy or fatty materials which will be burned off in the sintering furnace as hereinafter described. The methods used to alloy and to atomize are those conventional to this art and form no part of the instant invention.

Typically, the iron alloy powder can have the following composition:

| | % by Weight |
|---|---|
| Manganese | 0.25 – 0.5 |
| Molybdenum | 0.25 – 0.5 |
| Nickel | 0.25 – 2.25 |
| Carbon | 0.2 – 0.9 |
| Iron | Remainder |

The powder is then formed into a briquette 14 or green compact by pressure compression in a die. This briquetting is used to control densification, shape, and general dimensional tolerances. Commonly, briquetting can accomplish densification up to about 85% of theroretical. Here, again, the type of compaction that is used can be varied; such as uniaxial or isostatic.

After compression, the briquette or preform is sintered 16. This is accomplished by placing the preform into a sintering furnace. These conventionally contain a preheating zone for lubricant burn-off, a hot zone for sintering, and cooling zone. Normally, sintering of ferrous materials is carried out at a temperature of about 2050° to 2100° F. Sintering is carried out in a protective atmosphere, i.e., one free of oxygen, in order to prevent internal oxidation and formation of oxidative scale on the surface of the preform. The furnace atmosphere in which the preforms are sintered contains the carbon potential to maintain the desired combined carbon level of the material. Any of the protective atmospheres conventionaly used for this purpose are suitable. Surface enrichment to increase the carbon content and thus provide a carburized condition on the surface of the preform can also be provided. It has been found in practice that such a step not only helps maintain hardness but also eliminates general cracks resulting from the subsequent quenching step.

An essential feature of the present invention is the heating of the preform 18 after sintering to a temperature above its austenizing temperature prior to forging. The particular temperature above austenizing that is chosen is varied depending mainly on the shape and cross-sectional thickness of the preform. Thus, for example, a preform having an austenizing temperature of about 1550° F. can be adjusted to a preforging temperature of about 1600° to 1900° F.

Immediately after being brought to the proper temperature, the preform is subjected to the forging operation 20 in a protective atmosphere wherein a single blow (one-step forging) of approximately 60 to 80 tons per square inch is used to shape the preform into the desired finished article.

The forged article is then permitted to attain a uniform temperature throughout approximating its austenizing temperature and promptly quenched in a conventional quenching bath 22. This also is essential in the present process.

It is preferred to use a conventional quenching oil bath although other quenching baths, such as water containing ethylene glycol, can be used.

It has been found that the careful regulation of the temperature prior to forging and quenching eliminates the need for any further heat treatment prior to forging and quenching eliminates the need for any further heat treatment or working of the article to attain the desired tolerances and hardness throughout the article. Moreover, by operating in a protective atmosphere during sintering and forging, formation of any oxidative scale is avoided. The article 26 is in a finished condition after removal 24 from the quenching bath.

With respect to hardness, the instant process obtains hardness that are 40 – 62 Rc or higher. It will be evident that, if a lower hardness is desired, the finished article can be further heat treated. Similarly, the product can be selective or surface hardened.

The invention will be further described in connection with the following examples which are set forth for purposes of illustration only.

EXAMPLE 1

An iron alloy powder was prepared having the following formula:

| | % by Weight |
|---|---|
| Manganese | 0.25 |
| Molybdenum | 0.5 |
| Nickel | 1.8 |
| Carbon | .6 |
| Iron | 96.85 |
| | 100.00 |

The iron, manganese, molybdenum and nickel were alloyed in the usual manner and the alloy atomized to produce iron alloy powder. This powder admixed with graphite to supply the carbon and with a lubricant (Acrawax—a hard, white, synthetic wax having a melting point of 94–97° C.), was placed into the die cavity of a standard briquetting press where pressure was applied and the powder formed into a briquette (green compact) of sufficient strength to permit further handling.

The briquette was then sintered in a sintering furnace at approximately 2050° F. for about 30 minutes in a protective atmosphere. The furnace was of the available type containing a zone for lubricant burn-off, a hot zone for sintering, and a cooling zone. The sintered preform was at a temperature of about 200° F. when removed from the sintering furnace. The sintered preform was then heated to a temperature of approximately 1650° F., in a protective atmosphere in an electric heating core. This temperature was above the austenizing temperature (1550° F.) of the material.

The heated preform was then promptly transferred to a forging press and formed by a stroke of approximately 60 tons per square inch pressure into a forged stator clutch race having a smooth O.D. and a splined I.D. After forging, the forged article was allowed to stabilize and cool to its austenizing temperature of about 1550° F. and promptly quenched in a conventional oil bath.

The article was free of surface oxidative scale and was tested and found to have a density of 7.82 grams/cc (min.) or a density 99.6% that of theoretical; 7.87 grams/cc being the accepted theoretical maximum density. Most important, the product had a hardness, throughout the part of Rc 59–62. Equally importantly, the article had the desired shape and dimensions, thus eliminating the need for further processing, to obtain the desired hardness of the product.

EXAMPLE 2

An iron alloy powder is prepared in Example 1 but having the following composition:

| | % by Weight |
|---|---|
| Nickel | 0.5 |
| Manganese | 0.3 |
| Molybdenum | 0.5 |
| Carbon | 0.65 |
| Iron | Remainder |
| | 100.0 |

The graphite and lubricant are added as in Example 1 and the mixture deposited in the die cavity of the die set of a conventional briquetting press and compressed into a briquette. This briquette, then sintered, is heated, forged, quenched and stress relieved as described in Example 1. The forged article thus produced was also found upon inspection to possess an excellent surface quality free from oxidation scale and other surface imperfections and immediately salable without further treatment. Its hardness is found by test to extend entirely through the article, with similar properties extending in all directions.

EXAMPLE 3

A nickel-content iron alloy powder is prepared as in Example 1 having the following formula:

| | % by Weight |
|---|---|
| Nickel | 2.0 |
| Manganese | 0.25 |
| Molybdenum | 0.3 |
| Carbon | 0.5 |
| Iron | Remainder |
| | 100.0 |

The processing steps of Example 1 are followed to form a finished forged article. The forged article thus produced is also found upon inspection to possess an excellent surface quality free from oxidation scale and other surface imperfections so as to be immediately salable without further surface treatment. The hardness of the article, as in Example 1 and 2 above, is found by test to extend entirely through the article, with similar properties extending in all directions, and in this instance was Rc 55–57.

Experience in carrying out the process of the present invention has shown that such an excellent surface quality is obtained that the product can be sold and shipped as it was forged, without the usual machining to remove 20 to 30 thousandths of an inch in order to eliminate the surface deterioration which has hitherto occurrred. Furthermore, the obtaining, by this method, of the ultimate product immediately after forging, causes the tolerances required when, as previously, the dimensions of the article changed when the article was carburized after forging. Thus, the quenching immediately after forging, according to the present method, eliminates the extra tolerance spread acquired by variations in dimensions occurring during the subsequent reheating by previous procedures, such as carburization.

The high hardnesses achieved by the forging and quenching method of the present invention are ideally suited for mechanical parts which are required to sustain heavy running loads during operation, especially where the hardnesses are so high that the material cannot be machined but can only be ground, namely above 35 Rockwell "C". Anti-friction bearing races, for example, will wear rapidly and will not survive unless they have hardnesses in the neighborhood of 57 or 58 Rockwell C.

While the invention has been described in connection with a preferred embodiment, it is not intended to limit the invention to the particular form set forth, but on the contrary, it is intended to cover such alternatives, modifications and equivalents as may be included within the spirit and scope of the invention as defined by the appended claims.

What is claimed is:

1. A method of making a through-hardened scale-free forged powdered metal article having a density of at least about 99.5% of theoretical, a surface hardness of at least Rc 40, and an as forged dimension requiring no further machining other than surface grinding, all directly from quenching comprising:

compressing an iron alloy powder into a briquette, sintering said briquette into a sintered preform;

adjusting the temperature of said preform to such degree as to put said preform in an austenetic condition;

forging said heated preform in one step while at said austenetic condition into a forged article;

quenching said forged article in an oil quenching bath substantially immediately after said forging step while remaining in said austenetic condition; and removing said quenched forged article from the quenching bath, and stress relieving said forged article to produce a forged powdered metal article having a surface hardness of at least Rc 40 and a surface finish and dimension requiring no further machining other than surface grinding.

2. The method of claim 1, wherein the powdered alloy composition comprises, for each 100% by weight, 0.25 to 0.5% manganese, 0.25 to 0.5% nickel, 0.2 to 0.9% carbon and the remainder iron.

3. The method of claim 2, wherein the sintering of said briquette is accomplished in a gaseous atmosphere of high carbon potential and provides a carburizing effect on the surface of the preform.

4. The method of claim 3, wherein the powdered alloy composition comprises 0.5 to 0.9% carbon.

5. The method of claim 1, wherein the adjustment of the preform temperature prior to forging is carried out immediately after sintering to conserve heat energy by utilizing the residual heat of the sintered (article) preform toward reaching an austenizing temperature range which assures the preform being in an austenetic condition and also by eliminating the necessity of expending heat in subsequent carburization to attain the desired hardness.

6. The method of claim 1, wherein following said forging step and prior to said quenching step the temperature of the forged article is allowed to become substantially stabilized.

* * * * *

UNITED STATES PATENT OFFICE
CERTIFICATE OF CORRECTION

PATENT NO. : 4,002,471
DATED : January 11, 1977
INVENTOR(S) : MYRON C. SARNES and ROBERT N. HAYNIE It is certified that error appears in the above-identified patent and that said Letters Patent are hereby corrected as shown below:

In the ABSTRACT the final word "batch" should be -- bath --.

Column 6, line 9, (part of claim 1), "austenetic" should read -- austenitic --.

Column 6, line 12, (part of claim 1), "austenetic" should read -- austenitic --.

Column 6, line 22, (part of claim 2), between "0.5%"(second occurrence) and "nickel" insert -- molybdenum, 0.25 to 2.25%-- .

Column 6, line 35, (part of claim 5), "austenetic" should read -- austenitic --.

Signed and Sealed this
Thirty-first Day of May 1977

[SEAL]

*Attest:*

RUTH C. MASON
*Attesting Officer*

C. MARSHALL DANN
*Commissioner of Patents and Trademarks*